United States Patent [19]

Lardellier

[11] 4,295,785

[45] Oct. 20, 1981

[54] REMOVABLE SEALING GASKET FOR DISTRIBUTOR SEGMENTS OF A JET ENGINE

[75] Inventor: Alain M. J. Lardellier, Melun, France

[73] Assignee: Societe Nationale d'Etude et de Construction de Moteurs d'Aviation, Paris, France

[21] Appl. No.: 131,459

[22] Filed: Mar. 18, 1980

[30] Foreign Application Priority Data

Mar. 27, 1979 [FR] France ..... 79 07590

[51] Int. Cl.[3] ..... F01D 11/02

[52] U.S. Cl. ..... 415/174; 415/139; 415/217; 277/166

[58] Field of Search ..... 415/139, 172 A, 174, 415/189, 216, 217, 218; 277/53, 166

[56] References Cited

U.S. PATENT DOCUMENTS

| | | | |
|---|---|---|---|
| 2,640,679 | 6/1953 | Wheatley et al. | 415/172 A |
| 2,962,809 | 12/1960 | Short et al. | 415/174 |
| 3,601,414 | 8/1971 | Rao | 415/172 A X |
| 3,727,660 | 4/1973 | Burge | 415/172 A X |
| 3,752,599 | 8/1973 | Pace | 415/217 X |
| 3,846,899 | 11/1974 | Gross | 415/174 X |
| 4,087,199 | 5/1978 | Hemsworth | 415/174 |

*Primary Examiner*—Leonard E. Smith

*Attorney, Agent, or Firm*—Bacon & Thomas

[57] ABSTRACT

The invention concerns a mode of fastening a seal to the guide vanes of a jet engine. According to the invention, a gasket is attached to the inside bottom of a channel shaped support which is engaged by an internal ferrule of a guide vanes, the ferrule having L-shaped recesses and tongues of conforming configuration on the seal support to engage in those recesses.

8 Claims, 5 Drawing Figures

REMOVABLE SEALING GASKET FOR DISTRIBUTOR SEGMENTS OF A JET ENGINE

BACKGROUND OF THE INVENTION

The present invention is in the field of removable seals for guide vanes segments of a jet engine.

Distributors for turbines are known which consist of sectors comprising a plurality of blades cast in clusters and secured with their roots to the housing of the turbine and their heads connected by an internal ferrule defining a flange to which a ring carrying a seal is fastened, said seal cooperating with teeth of a rotor to form a labyrinth seal.

In a known manner, rings are mounted on the internal flange by means of bolts, but because of the high thermal stresses to which the fasteners are submitted, it is necessary to use large diameter threaded bolts and the corresponding nuts are subjected to considerable heating in the turbulence generated by the proximity of the teeth of the rotor.

As a consequence, the resulting excessive size of the bolts itself creates turbulence in the fastening zones, which is detrimental to fluid flow in the guide vanes.

Furthermore, the loss of a bolt would have severe consequences for the functioning of the jet engine.

SUMMARY OF THE INVENTION

The present invention concerns a removable seal which eliminates fastening by means of bolts.

According to the present invention, the seal is secured to the bottom of a supporting element in the form of a U-shaped gutter, to which is attached the internal ferrule of the segments of a guide vanes having a corresponding U-section, said ferrule comprising on its radial faces a plurality of L-shaped recesses extending radially and circumferentially and which are engaged by conforming tongues in the radial faces of the supporting element for the seal.

The L-shaped recesses formed in the radial faces of the ferrule may consist of slits cut into the wall of the faces, or sockets machined into the thickness of cast embossments, by electroerosion for example.

With this arrangement the seal is rigidly fixed to the guide vanes, the latter being rigid with the housing of the turbine, while the thermal expansion of the housing is controlled by a system of alternating cooling and heating, so that the clearance between the stator and the rotor is regulated perfectly.

BRIEF DESCRIPTION OF THE DRAWINGS

Other characteristics and advantages of the invention will be better understood by the description to follow hereinafter of several examples of embodiment and by referring to the drawings attached hereto, wherein.

DESCRIPTION OF THE PREFERRED EMBODIMENT

Figure 1:
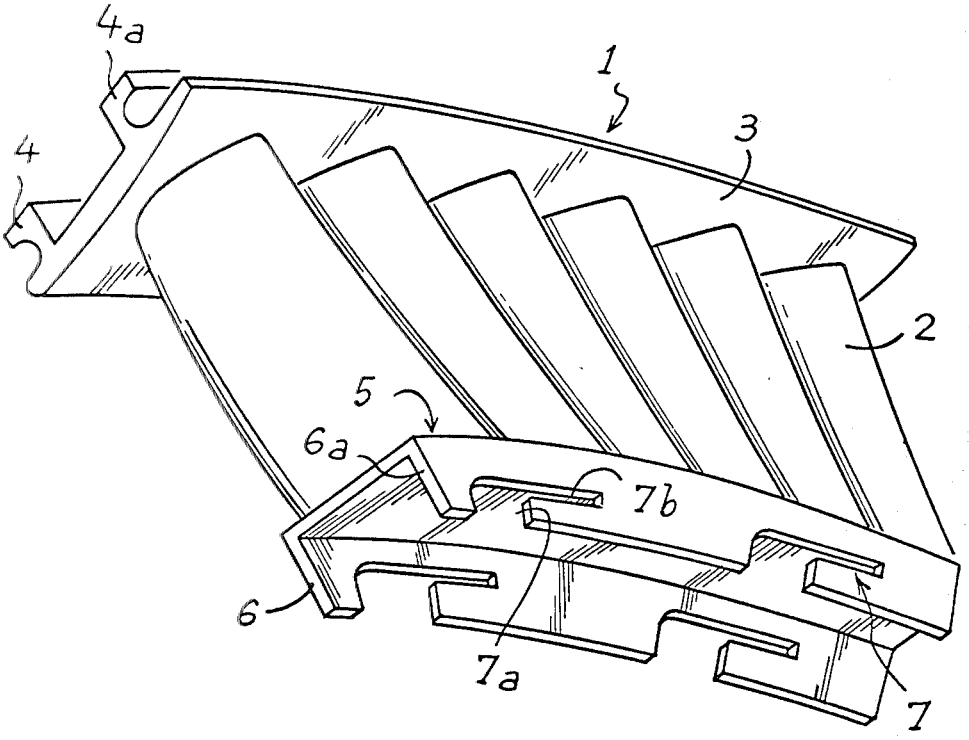
FIG. 1 is a perspective view of a guide vanes segment with the seal removed.

FIG. 1 shows a segment 1 of a guide vanes consisting of a casting including blades 2, which are connected to each other by means of an external ferrule 3 with its fastening elements 4, 4*a* for mounting on the housing of the turbine and by an internal ferrule 5.

The internal ferrule 5 has the configuration of a U-shaped channel, with its radial flanges 6, 6*a* having, in the example shown, slits 7 in the shape of an L, with a radial leg 7*a* opening to the edge of said flanges and legs 7*b*, which extend circumferentially.

Figure 3:
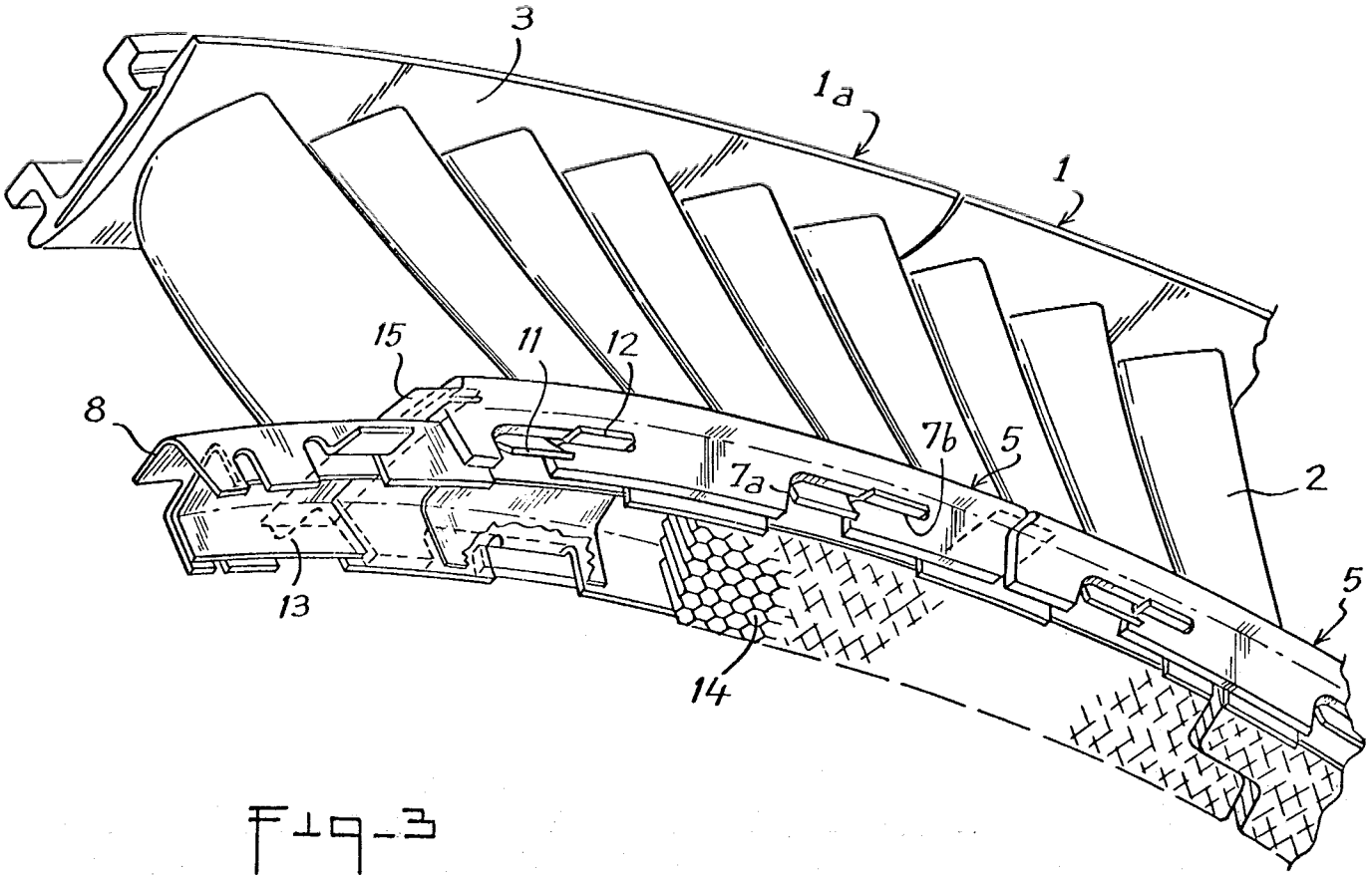
FIG. 3 is a perspective view of the seal supporting element mounted on several segments of the guide vanes.

A supporting element 8 for the seal is engaged (FIG. 3) inside the ferrule 5.

Figure 2:
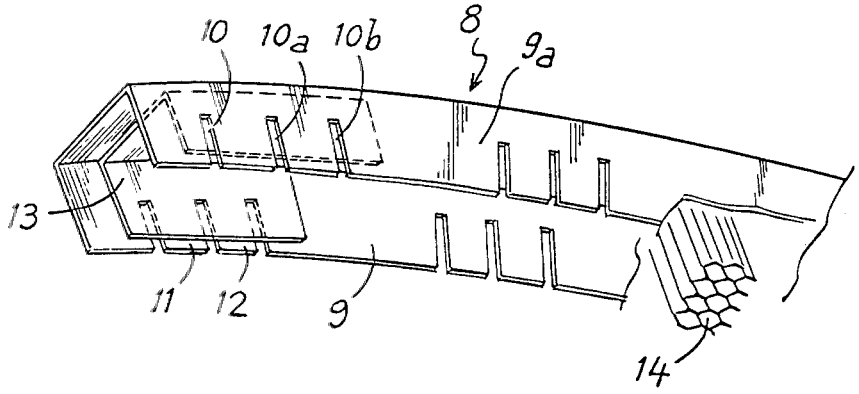
FIG. 2 is a perspective view of the seal supporting element.

The supporting element 8 (FIGS. 2 and 3) consist of a sheet metal channel bent to the shape of a U, having a length that may correspond to that of several sectors 1, 1*a*, to which the supporting element 8 is attached.

The supporting element 8 has on its radial flanges 9, 9*a* (FIG. 2) a series of slits 10, 10*a*, 10*b* in a regular spacing at a rate corresponding to that of the slits 7 in the internal ferrule of the guide vane, so that each series of slits 10, 10*a*, 10*b* outlines a plurality of tongues 11 and 12, one of which 12, bent to extend at right angles to the radial flanges 9, 9*a* is engaged (FIG. 3) in the circumferential part 7*b* of the slit 7 of the ferrule 5; the other, 11, is engaged after having been bent in the radial part 7*a* of the slit 7.

Inside the supporting element 8, there is mounted, for example by welding, a plurality of sealing elements 13 of U-shaped configuration, located to the right of the slits 10, 10*a*, 10*b*, so that when the tongues 12 are raised to be engaged in the slits 7, gas tightness is always assured in both the upstream and downstream directions.

The seal 14, consisting in particular of a honeycomb cladding, is secured within and to the bottom of the supporting element 8 (FIGS. 2 and 3), by brazing, for example.

Figure 4:
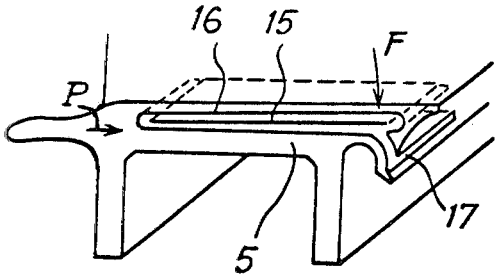
FIG. 4 is a perspective view of the internal ferrule and of the mounting of the connecting plates between segments of the guide vanes.
Figure 5:
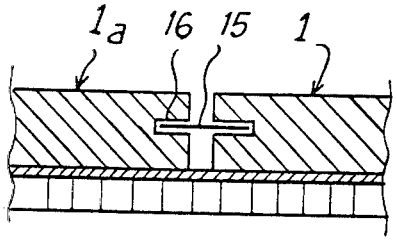
FIG. 5 is a view in transverse section showing a connecting plate between two segments of the guide vanes.

Sealing between two segments 1, 1*a* of the guide vane at the jet level may be accomplished by means of plates 15 (FIGS. 3, 4, 5) engaged in slits 16 cut into the ends of the internal ferrule 5 of the guide vane segments and define a lateral opening 17 to engage the plate 15.

After its engagement in the opening 17 of the slit 16, the plate 15 is pushed inwardly and becomes seated in said groove. To extract the plate 15, a force F and then a thrust P is applied by means of a square introduced between two segments of the guide vane.

To install the seal, one proceeds in the following manner:

When all of the segments 1 of the guide vane are in place, the supporting element 8 for the seal 14 is introduced in the internal ferrule 5 of the guide vane so that the bent tongues 12 engage in the radial leg 7*a* of the L-shaped slits 7, provided on the radial faces 6, 6*a* of the ferrule.

Then, by applying slight mallet strokes to the edge in front of the supporting element 8, the tongues 12 are made to penetrate the circumferential part 7*b* of the slits 7 of the guide vane, which has the effect of radially locking the supporting element of the seal.

This operation is repeated for all of the supporting elements of the seal, which are all alike, the clearance between the supporting elements being sufficient to provide adequate space for the insertion of the last supporting element, by forcing them against each other by means of a mallet. The supporting elements of the seal are then loosened to redistribute the clearances among them.

If for structural reasons, the clearances are insufficient for this procedure all of the supporting elements may be introduced in the internal ferrules; they are tapped tangentially and successively from below with the aid of a tool which engages in the notches of the flanges 9 and 9*a*, resulting from bending the tongues 12.

Subsequently, the tongues 11, engaged in the radial legs 7*a* of the slits 7, are bent outwardly, which has the effect of circumferentially locking the seal 14 to the guide vane.

It may be of advantage to bend only the tongues 11 to an angle sufficient to insure the circumferential locking of the supporting elements of the seal, because then they participate in the sealing action and the elimination of the closing elements 13 may be considered.

Further, the slits 7 in the shape of an L, are oriented so that the rotation of the part 8 causes the tongues 12 to engage the end of the leg 7*b* of the slit in the locking direction; the failure of a tongue 11 thus cannot cause the loss of the supporting element 8 of the seal.

To assure circumferential locking, it is possible to bend only one tongue 11 of two. The second tongue will then be available during reassembly, if it should be found that the first assembly is not sufficiently safe.

In this manner, the seal is rigid with the guide vane, which in turn is rigid with the turbine housing, with the thermal expansion of the latter being controlled by a system of alternating cooling and heating; the clearance between the stator and the rotor is then controlled perfectly.

Sealing between two segments 1, 1*a* with respect to the jet may be accomplished by the plates 15, which are introduced into the recesses 16 provided on the internal ferrule 5.

This arrangement does not improve the upstream downstream sealing of the seal 14, but it effectively reconstitutes the jet; this is particularly important at the downstream rim.

Such a device makes it possible to link the seal to the movements of the turbine housing and thus to optimize the clearance between the rotor and the stator of the labyrinth; furthermore, it maintains the sectors in their plane.

It should be understood that various modifications may be applied to the devices or processes described hereinabove merely as non limiting examples, without exceeding the scope of the invention.

I claim:

1. In a removable seal for guide vane segments of a jet engine wherein a plurality of blades are interconnected by an outer ferrule engageable with a turbine housing and by an inner ferrule upon which the seal is mounted, the improvement comprising:

said seal being mounted in an inwardly facing channel-shaped member removably attached to said inner ferrule, said inner ferrule being an inwardly facing channel-shaped member having, in its outer sides, a plurality of L-shaped recesses each having a leg opening radially inwardly to the inner edge of said outer sides and a circumferentially extending leg, said recesses being engaged by locking tongues on said channel-shaped member.

2. A seal as defined in claim 1 wherein said L-shaped recesses are slits formed in the sides of said inner ferrule.

3. A seal as defined in claim 1 wherein said L-shaped recesses are grooves formed in the sides of embossments on radial faces of said inner ferrule.

4. A seal as defined in claim 1 wherein said guide vanes segments are arranged in end-to-end relation;

the adjacent ends of adjacent segments having opposed slits therein; and connecting plates spanning the space between said segments and extending into said slits.

5. A seal as defined in claim 1 wherein said channel-shaped member in which said seal is mounted is formed of sheet metal and is of a length equal to several of said guide vane segments;

radial slits in the sides of said sheet metal member defining the sides of said locking tongues; and said radial slits being spaced corresponding to the spacing of said L-shaped recesses.

6. A seal as defined in claim 5 wherein U-shaped sealing elements are fixed in said sheet metal channel member to overlie and close said slits.

7. A seal as defined in claim 5 wherein there are three of said radial slits defining the sides of two adjacent locking tongues;

one of said tongues engaging in the circumferentially extending leg of an L-shaped recess and the other tongue engaging in the radial leg of that recess.

8. A seal as defined in claim 7 wherein said L-shaped recesses are so oriented in relation to the direction of rotation of a rotor of said jet engine that engagement of the rotor with the seal urges said locking tongues in the locking direction.

* * * * *